United States Patent [19]

Dotson

[11] Patent Number: 4,657,489

[45] Date of Patent: Apr. 14, 1987

[54] FLUID PUMPING APPARATUS

[76] Inventor: James E. Dotson, 5206 S. Harvard, Apt. 225, Tulsa, Okla. 74105

[21] Appl. No.: 796,653

[22] Filed: Nov. 8, 1985

[51] Int. Cl.[4] ..... F04B 19/02

[52] U.S. Cl. ..... 417/467; 92/66

[58] Field of Search ..... 92/66, 137; 417/460, 417/467

[56] References Cited

U.S. PATENT DOCUMENTS

| | | | |
|---|---|---|---|
| 276,048 | 4/1883 | Johnston | 417/467 |
| 406,442 | 7/1889 | Hayes | 417/467 |
| 470,695 | 7/1892 | Morand | 417/467 |
| 616,819 | 12/1898 | Barzee | 417/467 |
| 1,343,427 | 6/1920 | Anderson | 417/467 |
| 1,420,052 | 6/1922 | Montgomery | 417/467 |
| 2,981,198 | 4/1961 | Neffel | 417/468 |

FOREIGN PATENT DOCUMENTS

| | | | |
|---|---|---|---|
| 222542 | 10/1924 | United Kingdom | 417/467 |

*Primary Examiner*—Carlton R. Croyle
*Assistant Examiner*—Paul F. Neils
*Attorney, Agent, or Firm*—Head Johnson Stevenson

[57] ABSTRACT

A fluid pumping apparatus includes at least two counter-balanced, counter-reciprocating pump assemblies. Each pump assembly includes at least two generally vertical, balanced, reciprocating pumps.

8 Claims, 4 Drawing Figures

FLUID PUMPING APPARATUS

BACKGROUND OF THE INVENTION

The present invention generally relates to apparatus for pumping fluids and, more particularly, to such an apparatus which includes at least two counterbalanced, counter-reciprocating pump assemblies.

SUMMARY OF THE INVENTION

Although reciprocating pumps are well known and used, the present invention provides a unique fluid pumping apparatus which counterbalances the weights of at least two reciprocating pumps and the fluid internal to the pumps, and counter-reciprocates the pumps to provide an efficient method of pumping and lifting fluids. The fluid pumping apparatus of the present invention comprises at least two counterbalanced, counter-reciprocating pump assemblies. Each pump assembly is comprised of at least two generally vertical, balanced, reciprocating pumps.

DESCRIPTION OF THE PREFERRED EMBODIMENTS

Before explaining the present invention in detail, it is to be understood that the invention is not limited to its application to the details of construction and arrangement of parts illustrated in the accompanying drawings, since the invention is capable of other embodiments and of being practiced or carried out in various ways commensurate with the claims herein. Also it is to be understood that the phraseology or terminology employed herein is for the purpose of description and not of limitation.

Figure 1:
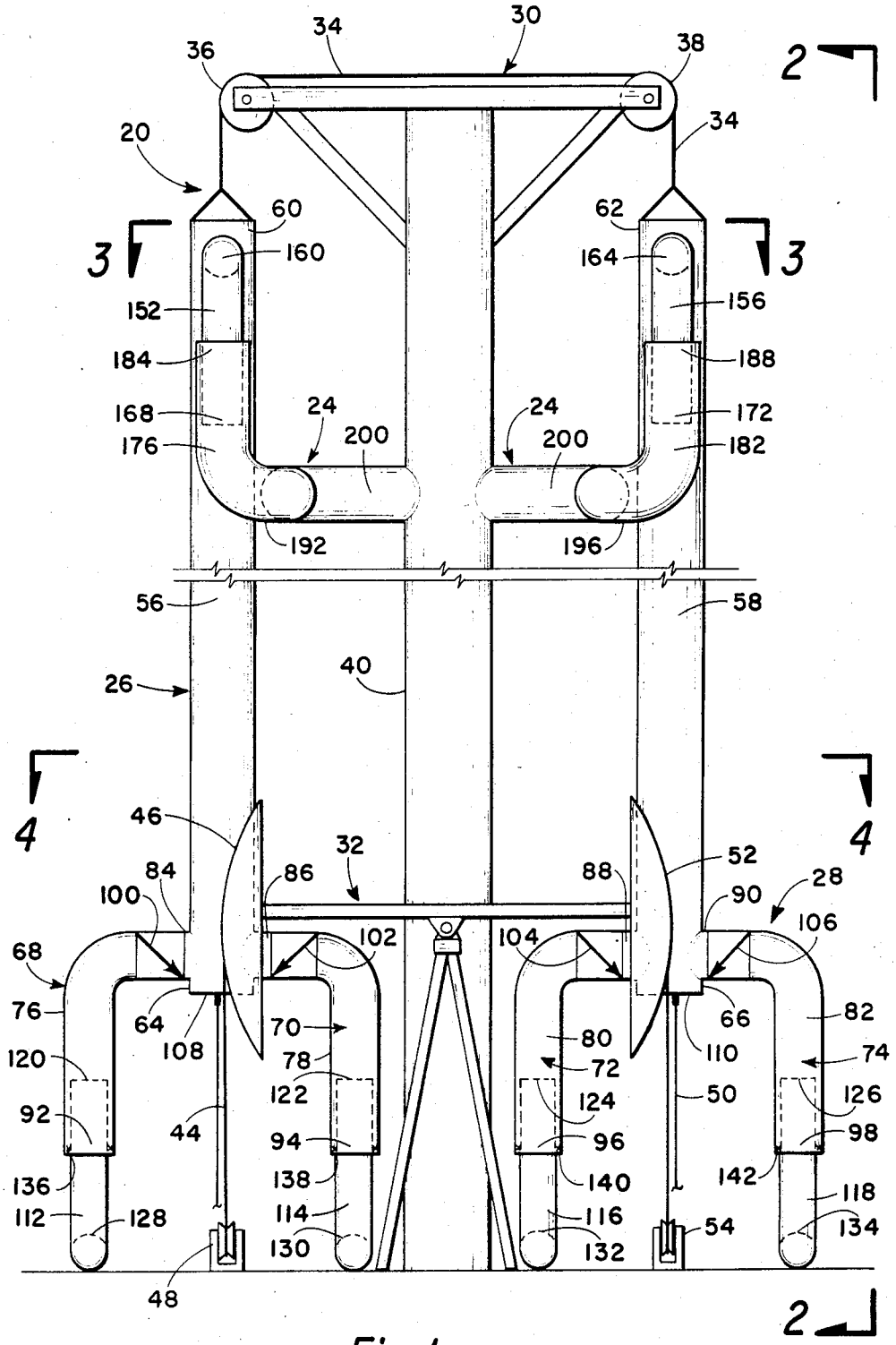
FIG. 1 is a front view of the fluid pumping apparatus.
Figure 2:
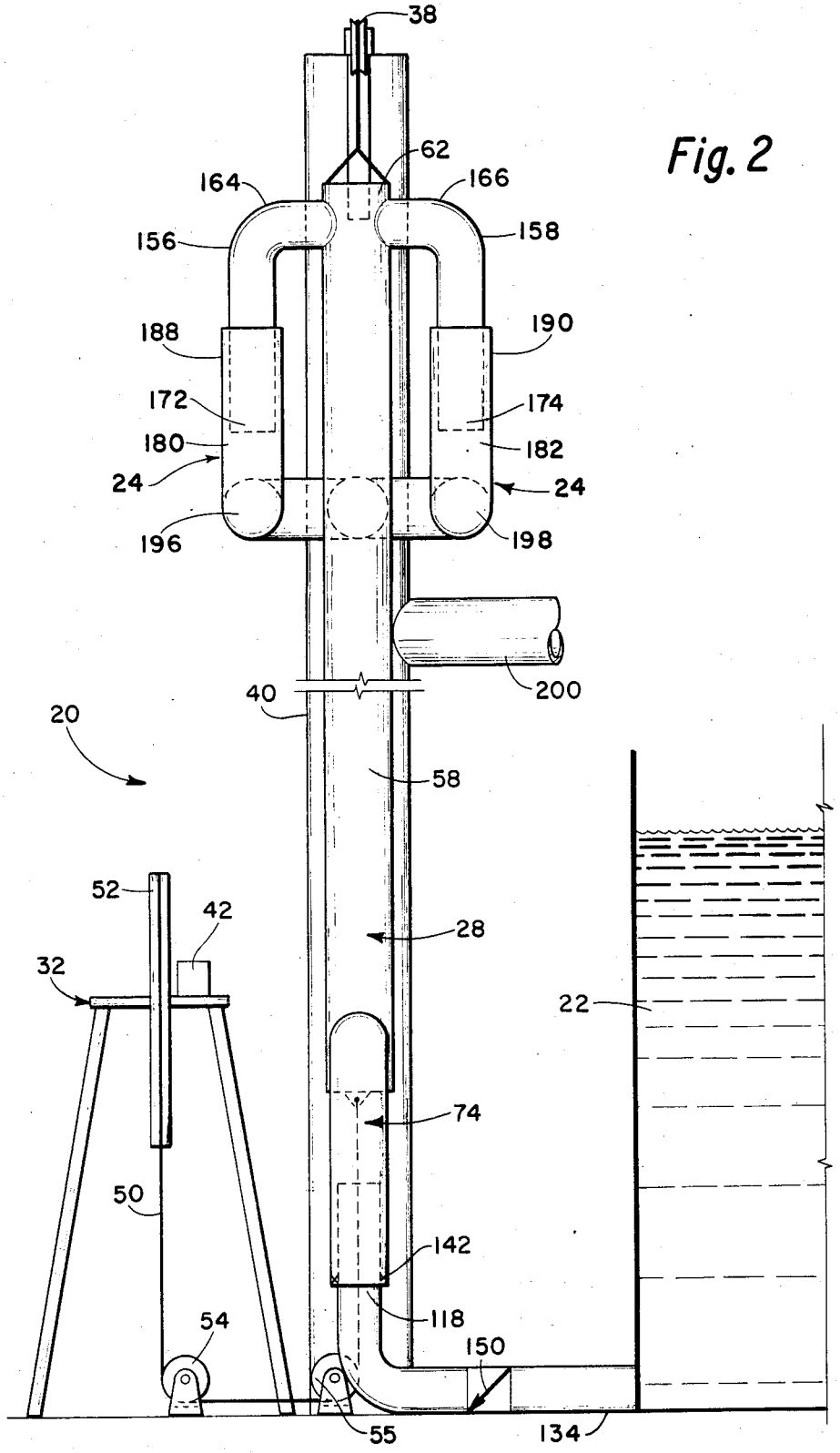
FIG. 2 is a side view of the fluid pumping apparatus as viewed from line 2—2 of FIG. 1.

With reference to FIGS. 1 and 2, the fluid pumping apparatus of the present invention is generally designated by the reference number 20 and comprises a fluid supply 22; discharge receiving means, generally designated 24, for receiving and routing fluid which is discharged from the pumping apparatus 20; at least two reciprocating pump assemblies, generally designated 26 and 28; counterbalancing means 30 for counter-balancingly suspending the pump assemblies 26 and 28; and counter-reciprocating means 32 for counter-reciprocating the pump assemblies 26 and 28. In FIG. 1 there are two pumping assemblies, although more may be provided, the only limitation being that the pumping assemblies remain counterbalanced in order to retain the efficiency of the pumping apparatus 20.

Reffering to FIG. 1, in the example embodiment the counter balancing means 30 is a cable, wire, chain, or equivalent 34, and sheaves, pulleys, sprockets, or equivalent 36 and 38. One end of the cable 34 is attached to pumping assembly 26, the cable 34 is then routed over sheaves 36 and 38, and the other end of cable 34 is attached to pumping assembly 28. The sheaves 36 and 38 should be located in the same horizontal plane and should precisely counterbalance the pumping assemblies 26 and 28. The components of the pumping asemblies 26 and 28 should be carefully matched in size and weight so that the weight of the pumping assemblies 26 and 28 is as closely matched as possible when the pumping assemblies are full of fluid. In the example, embodiment the sheaves 36 and 38 are mounted on the support structure 40 of the discharge receiving means 24, although the sheaves may be mounted on any support of adequate height and structural strength.

Referring to FIGS. 1 and 2, in the example embodiment the counter reciprocating means 32 is an even-span balanced walking beam which is driven by a motor and gear box 42. The motor may be an electric motor, internal combustion engine, water wheel, or any other prime mover which may be coupled to the pumping apparatus 20. The walking beam 32 and motor and gear box 42 should be designed to operate the pumping apparatus 20 with the desired stroke length and the desired number of strokes per minute, which will vary with the size and mass of the apparatus 20. In FIG. 1 a cable, wire, chain, or equivalent 44 is connected from the first end 46 of the walking beam around sheaves, pulleys, sprockets, or equivalent 48 and 49 to pump assembly 26; and cable, wire, chain, or equivalent, 50 is connected from the second end 52 of the walking beam around sheaves, pulleys, sprockets, or equivalent 54 and 55 to pump assembly 28. Cables 44 and 50 should be tautly connected between the walking beam 32 and pump assemblies 26 and 28 so that all motion of the walking beam is transferred to counter-reciprocate the pump assemblies 26 and 28.

Referring to FIG. 1, in the example embodiment each of the pump assemblies 26 and 28 comprise a generally vertical lifting conduit 56 or 58 having a first end 60 or 62 and a second end 64 or 66 and at least two balanced, reciprocating pumps 68 and 70 or 72 and 74. The first end 60 or 62 of the lifting conduit 56 or 58 should be in slidingly reciprocable, essentially fluid leakage preventive contact with discharge receiving means 24.

As exemplified in FIG. 1, each of the balanced, reciprocating pumps 68, 70, 72 or 74 comprises a generally vertical traveling conduit 76, 78, 80, or 82 which has a first end 84, 86, 88, or 90 connected to the vertical side near the second end 64 or 66 of the lifting conduit 56 or 58, and a second end 92, 94, 96, or 98. In the embodiment of FIG. 1 the first end 84, 86, 88, or 90 of the traveling conduit is welded to the vertical side of the lifting conduit 56 or 58, although other forms of connection, such as flanging are acceptable. Each pump 68, 70, 72, or 74 also comprises a traveling check means 100, 102, 104, or 106, located in each traveling conduit 76, 78, 80, or 82 near the first end 84, 86, 88, or 90 of the traveling conduit, for allowing fluid to flow from the second end 92, 94, 96, or 98 of the traveling conduit through the first end 84, 86, 88, or 90 of the traveling conduit and not allowing fluid to back flow from the first end to the second end of the traveling conduit. As exemplified in of FIG. 1 the first end 84, 86, 88, or 90 of the traveling conduit 76, 78, 80 or 82 is horizontally connected to the lifting conduit 56 or 58 near the second end 64 or 66 of the lifting conduit and each traveling check means 100, 102, 104, or 106 is located in a generally horizontal position near the first end 84, 86, 88, or 90 of the traveling conduit. The traveling check means may be a conventional check valve or equivalent.

The connection of the first end 84, 86, 88, or 90 of the traveling conduit 76, 78, 80, or 82 to the vertical side of the lifting conduit 56 or 58 creates a dead end 108 or 110 at the sealed second end 64 or 66 of the lifting conduit. The dead ends 108 and 110 provide surfaces of equal area at right angles to the columns of liquid in the lifting conduits 56 and 58 to assist in balancing the pump assemblies 26 and 28. Since the lifting conduits 56 and 58 are the same height and diameter and both are liquid full throughout the reciprocation of the pump assemblies 26 and 28, the same amount of liquid and liquid head is present above the horizontal surfaces of the dead ends 108 and 110 throughout the reciprocation of the pump assemblies.

Referring to FIGS. 1 and 2, in the example embodiment each reciprocating pump 68, 70, 72, or 74 further comprises a generally vertical fluid piston conduit 112, 114, 116, or 118 for connecting the traveling conduit 76, 78, 80, or 82 to the fluid supply 22. Each piston conduit 112, 114, 116, or 118 has a first end 120, 122, 124, or 126 and a second end 128, 130, 132, or 134. The first end 120, 122, 124, or 126 of the piston conduit engages the second end 92, 94, 96, or 98 of the traveling conduit 76, 78, 80 or 82 in a slidingly reciprocable and essentially fluid leakage preventive manner. In FIG. 1 the engagement of the piston conduit 112, 114, 116, or 118 and traveling conduit 76, 78, 80, or 82 is sealed with a conventional "O"-ring seal 136, 138, 140, or 142. The second end 128, 130, 132, or 134 of the piston conduit is connected to the fluid supply 22. The second end 128, 130, 132, or 134 of the piston conduit 112, 114, 116, or 118 may be flanged, welded, or connected to the fluid supply in any other equivalent manner.

Figure 4:
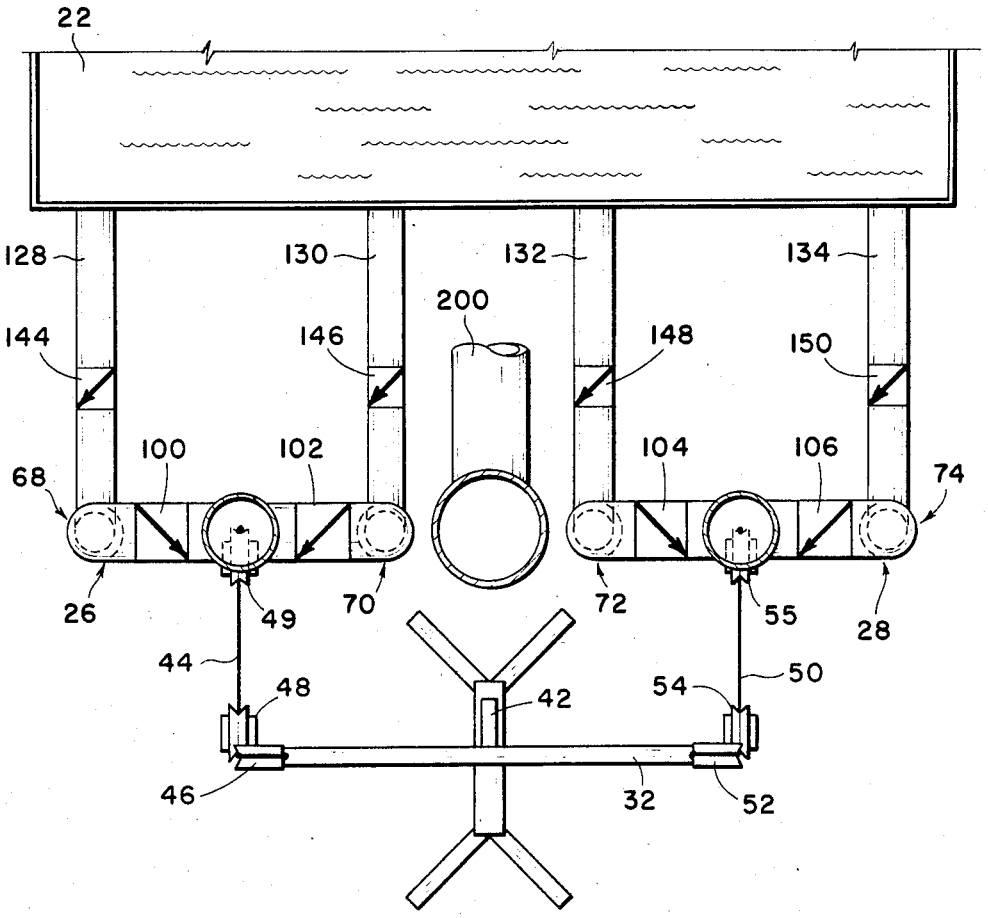
FIG. 4 is a sectional view from line 4—4 of FIG. 1.

Each reciprocating pump 68, 70, 72, or 74 further comprises a stationary check means 144, 146, 148, or 150 which is located in the piston conduit 112, 114, 116, or 118 for allowing fluid to flow through the piston conduit from the fluid supply 22 and not allowing fluid to back flow through the piston conduit 112, 114, 116, or 118 into the fluid suppy. In the embodiment of FIGS. 2 and 4 the second end 128, 130, 132, or 134 of the piston conduit 112, 114, 116, or 118 is horizontally connected to the fluid supply 22 and each stationary check means 144, 146, 148, or 150 is located in a generally horizontal position near the second end 128, 130, 132, or 134 of the piston conduit.

Figure 3:
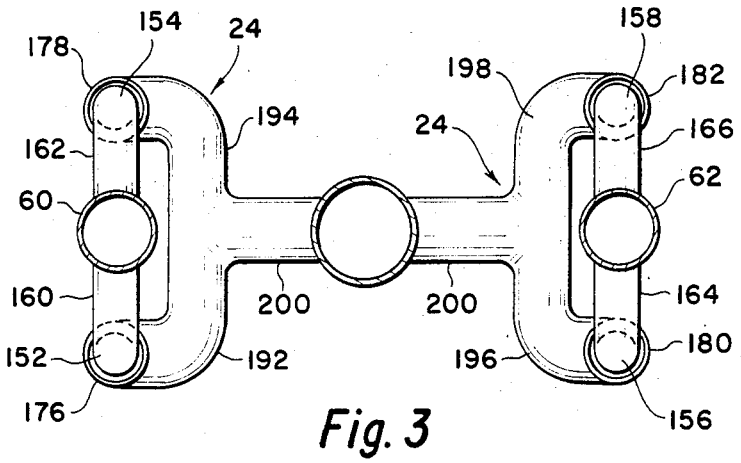
FIG. 3 is a sectional view from line 3—3 of FIG. 1.

As exemplified in of FIGS. 1, 2, and 3 each lifting conduit 56 and 58 further comprises at least two generally vertical, balanced spillway conduits 152 and 154 or 156 and 158. Each of the spillway conduits 152, 154, 156, or 158 has an upper first end 160, 162, 164, or 166 and a lower second end 168, 170 172, or 174. The upper first end 160, 162, 164, or 166 of each spillway conduit is connected to near the first end 60 or 62 of one of the lifting conduit 56 or 58. As exemplified in FIG. 2, the spillway conduit are generally in the shape of an inverted "L" with the horizontal portion of the "L" being flanged or welded to the first end 60 or 62 of the lifting conduit 56 or 58 and the vertical portion of the "L" engaging the discharge receiving means 24.

As illustrated in FIGS. 1, 2, 3, in the example embodiment the discharge receiving means 24 further comprises at least four generally vertical, balanced discharge conduit 176, 178, 180, or 182 each discharge conduit having an upper first end 184, 186, 188, or 190 and a lower second end 192, 194, 196, or 198. The upper first end 184, 186, 188,or 190 of each discharge conduit receives and is in continuous, reciprocable, non-contacting, frictionless engagement with the lower second end 168, 170, 172, or 174 of one of the spillway conduits 152, 154, 156, or 158. The lower second end 192, 194, 196, or 198 of each discharge conduit 176, 178, 180, or 182 is connected to a discharge header 200 which conducts the elevated, discharged fluid as may be required for its desired use.

The communication and engagement between the lifting conduit 56 or 58 and the discharge receiving means 24 may take any form which will transfer liquid from the lifting conduit 56 or 58 to the discharge receiving means 24 with a negligible amount of friction and liquid loss and which will allow the pumping apparatus 20 and the pumping assemblies 26 and 28 to remain in balance. For example, the first end 60 or 62 of the lifting conduit 56 or 58 may be an open ended straight pipe and the discharge receiving means may have a circular trough for each lifting conduit pipe. Each circular trough would encircle a lifting conduit and have an "O"-ring seal between the trough and the lifting pipe. As fluid is pumped out of the first end of the lifting conduits it would be caught in the circular troughs and flow into the discharge receiving means 24 for its destined use.

As illustrated in FIG. 1, the same structure 40 may be used to support both the discharge receiving means 24 and the pumping apparatus 20 although they may also be independently supported, as required by a specific application.

Referring to FIGS. 1 and 2, in use the motor 42 and walking beam 32 counter-reciprocate the pump assemblies 26 and 28, i.e., as one pump assembly rises the other falls, and each pump 68, 70, 72, and 74 reciprocates between and upper and lower position. In order for the pumping apparatus 20 to operate properly the elevation of the traveling check means 100, 102, 104, and 106 should be equal to or below the elevation of the fluid level in the fluid supply in both positions of the pumps 68, 70, 72, and 74.

Referring now to FIGS. 1, 2, and 3, the operation of the pumping apparatus 20 will be described. For ease of description, the operation will be described beginning with the pump assembly 26 in its lowermost position, at which point the pump assembly 28 is in its uppermost position. It will be assumed that both pump assemblies 26 and 28 have been filled with fluid before initiating operation. As pump assembly 26 begins to rise, traveling check means 100 or 102 are closed and sealed by the fluid above check means 100 and 102 as the fluid tries to back flow through check means 100 and 102. As pumping apparatus 26 continues to rise to its uppermost position the fluid in the lifting conduit 56 above the check means 100 and 102 is elevated, and the lifting of the check means 100 and 102 creates a suction beneath check means 100 and 102 which together with the elevation or head of liquid in the fluid supply causes liquid to flow in beneath check means 100 and 102, keeping the pump assembly 26 fluid full. As the pump assembly 26 begins to fall (and pump assembly 28 begins to rise) the fluid between traveling check means 100 and 102, which are closed, and stationary check means 144 and 146 tries to back flow through stationary check means 144 and 146 and stationary check means 144 and 146 close, creating fluid "pistons" between stationary check means 144 and 146 and traveling check means 100 and 102. As pump assembly 26 continues to fall, traveling check means 100 and 102 are opened by the fluid pressure created between the downward traveling check means 100 and 102 and closed stationary check means 144 and 146 and fluid flows through traveling check means 100 and 102 and out the first end of the lifting conduit 56 into discharging receiving means 24. Thus, as one pump assembly 26 or 28 rises and elevates a column of fluid the other pump assembly is falling and discharging a column of elevated fluid into the discharge receiving means 24.

It may therefore be seen, that by carefully balancing the pumping apparatus 20 and carefully aligning and selecting the conduit components of the pumping apparatus 20 to minimize friction in the apparatus an efficient pumping system may be obtained. The center of gravity and weight of each pump assembly 26 and 28 should be carefully balanced, both within each pump assembly 28 and 28 independently and between the two pump assemblies, so that the weights of the pump assemblies when full of liquid will be as closely matched as possible and so that the vertically hanging conduits of the pump assemblies will remain as perfectly vertical and aligned as possible throughout the cycle of the pumping apparatus 20 to minimize friction energy losses caused by the rubbing of misaligned components. The portions of the conduits which are in moving contact with other conduit or with seals, e.g., the first ends 116, 118, 120, and 122 of the piston conduits 108, 100, 112, and 114 and the second ends 92, 94, 96, or 98 of the traveling conduit, and the fluid contacting portions of the conduit, should be selected to have as low a coefficient of friction as possible in order to minimize the energy lost due to friction between the flowing fluid and the conduits and between the moving and stationary conduit. The cables 34, 44, and 50, sheaves 36, 38, 48, 49, 54, and 55, motor and gear box 42, walking beam 32, and check means 100, 102, 104, 106, 140, 142, 144, and 146 should also be selected and located to minimize friction and other energy losses in their operation.

The various conduits of the pumping apparatus 20 may be made of metal or polymer pipe or its equivalent, and the valves, sheaves, and fittings may be of metal, polymer or equivalent. The components and the apparatus may be of virtually any size, e.g., the diameter and length of the conduit and valves and the height of the apparatus, and may be designed and sized to provide the elevation and volume of fluid required by a specific application. The overriding consideration in the selection of the components should be to maintain as nearly perfect balance and alignment as possible in order to minimize the energy required to counter-reciprocate the pump assemblies 26 and 28 and to overcome the friction losses in the apparatus 20.

What is claimed is:

1. A fluid pumping apparatus for pumping fluid from a fluid supply comprising:

at least two reciprocating pump assemblies;

means for counterbalancing the pump assemblies;

means for counter-reciprocating the pump assemblies between an upper position and a lower position; and wherein each pump assembly comprises:

A. a generally vertical lifting conduit having a first end and a second end, the first end being the discharge end of the pump assembly, the second end of the lifting conduit comprising:

a dead end, sealingly positioned to provide a surface perpendicular to the column of liquid in the lifting conduit, the surface of the dead end in the lifting conduit of each pump assembly being of equal area;

B. at least two balanced, reciprocating pumps, each pump comprising:

1. a generally vertical traveling conduit having first end and a second end, the first end being connected to the vertical side of the lifting conduit near the second end of the lifting conduit;

2. a traveling check means, located in the traveling conduit near the first end of the traveling conduit, for allowing fluid to flow from the second end of the traveling conduit through the first end of the traveling conduit and not allowing fluid to back flow through the first end to the second end of the traveling conduit;

3. a generally vertical fluid piston conduit for connecting the traveling conduit to the fluid supply, the piston conduit having a first end and a second end, the first end of the piston conduit engaging the second end of the traveling conduit in a sliding and essentially fluid leakage preventive manner, and the second end of the piston conduit connecting to the fluid supply;

4. a stationary check means, located in the piston conduit, for allowing fluid to gravitationally flow through the piston conduit from the fluid supply and not allowing fluid to back flow through the piston conduit into the fluid supply; and 5. wherein the elevation of the traveling check means is equal to or below the elevation of the fluid level in the fluid supply in both positions of the pump assembly.

2. The fluid pumping apparatus of claim 1 wherein the first end of the traveling conduit is further defined as being horizontally connected to the lifting conduit near the second end of the lifting conduit; and wherein the traveling check means is further defined as being located in a generally horizontal position near the first end of the traveling conduit.

3. The fluid pumping apparatus of claim 1 wherein the second end of the piston conduit is further defined as being horizontally connected to the fluid supply; and wherein the stationary check means is further defined as being located in a generally horizontal position near the second end of the piston conduit.

4. The fluid pumping apparatus of claim 1, further comprising:

discharge receiving means for gravitationally receiving and routing fluid which is discharged from the pump assemblies.

5. The fluid pumping apparatus of claim 3 wherein each lifting conduit further comprises:

at least two generally vertical, balanced spillway conduits, each spillway conduit having an upper first end and a lower second end, the upper first end of each spillway conduit being connected to near the first end of one of the lifting conduits; and wherein the discharge receiving means further comprises:

at least four generally vertical, balanced discharge conduit, each discharge conduit having an upper first end and a lower second end, the upper first end receiving and being in continuous, reciprocable, non-contacting, frictionless engagement with the lower second end of one of the spillway conduits.

6. The fluid pumping apparatus of claim 4:

wherein the discharge receiving means is located at an elevation lower than the elevation of the first ends of each of the lifting conduits in the lower position of the pump assembly for gravitationally receiving the fluid discharged from the first ends of the lifting conduits.

7. A fluid pumping apparatus for pumping fluid from a fluid supply comprising:

at least two reciprocating pump assemblies;

means for counterbalancing the pump assemblies;

means for counter-reciprocating the pump assemblies between an upper position and a lower position; and wherein each pump assembly comprises:

A. a generally vertical lifting conduit having an upper first end and a lower second end, the first end being the discharge end of the pump assembly, the second end of the lifting conduit comprising:

a dead end, sealingly positioned to provide a surface perpendicular to the column of liquid in the lifting conduit, the surface of the dead end in the lifting conduit of each pump assembly being of equal area;

B. at least two balanced, reciprocating pumps, each pump comprising:

1. a generally vertical traveling conduit having an upper first end and a lower second end, the first end being connected to the vertical side of the lifting conduit near the second end of the lifting conduit;

2. a traveling check means, located in the traveling conduit near the first end of the traveling conduit, for allowing fluid to flow from the second end of the traveling conduit through the first end of the traveling conduit and not allowing fluid to back flow through the first end to the second end of the traveling conduit;

3. a generally vertical fluid piston conduit for connecting the traveling conduit to the fluid supply, the piston conduit having an upper first end and a lower second end, the first end of the piston conduit engaging the second end of the traveling conduit in a sliding and essentially fluid leakage preventive manner, and the second end of the piston conduit connecting to the fluid supply;

4. a stationary check means, located in the piston conduit, for allowing fluid to gravitationally flow through the piston conduit from the fluid supply and not allowing fluid to back flow through the piston conduit into the fluid supply; and 5. wherein the elevation of the traveling check means is equal to or below the elevation of the fluid level in the fluid supply in both positions of the pump assembly; and C. discharge receiving means, located at an elevation lower than the elevation of the first end of each of the lifting conduits in the lower position of the pump assembly, for gravitationally receiving the fluid discharged from the first ends of the lifting conduits.

8. A fluid pumping apparatus for pumping fluid from a fluid supply comprising:

at least two reciprocating pump assemblies;

means for counterbalancing the pump assemblies; and means for counter-reciprocating the pump assemblies between an upper position and a lower position; and wherein each pump assembly comprises:

A. a generally vertical lifting conduit having a first end and a second end, the first end being the discharge end of the pump assembly, the lifting conduit comprising:

at least two generally vertical, balanced spillway conduits, each spillway conduit having an upper first end and a lower second end, the upper first end of each spillway conduit being connected to near the first end of the lifting conduit;

B. at least two balanced, reciprocating pumps, each pump comprising:

1. a generally vertical traveling conduit having a first end and a second end, the first end being connected to the vertical side of the lifting conduit near the second end of the lifting conduit;

2. a traveling check means, located in the traveling conduit near the first end of the traveling conduit, for allowing fluid to flow from the second end of the traveling conduit through the first end of the traveling conduit and not allowing fluid to back flow through the first end to the second end of the traveling conduit;

3. a generally vertical fluid piston conduit for connecting the traveling conduit to the fluid supply, the piston conduit having a first end and a second end, the first end of the piston conduit engaging the second end of the traveling conduit in a sliding and essentially fluid leakage preventive manner, and the second end of the piston conduit connecting to the fluid supply;

4. a stationary check means, located in the piston conduit, for allowing fluid to flow through the piston conduit from the fluid supply and not allowing fluid to back flow through the piston conduit into the fluid supply; and 5. wherein the elevation of the traveling check means is equal to or below the elevation of the fluid level in the fluid supply in both positions of the pump assembly; and C. discharge receiving means, for receiving and routing fluid which is discharged from the pump assemblies, the discharge receiving means comprising:

at least four generally vertical, balanced discharge conduit, each discharge conduit having an upper first end and a lower second end, the upper first end receiving and being in continuous, reciprocable, non-contacting, frictionless engagement with the lower second end of one of the spillway conduits.

* * * * *